US007805943B2

(12) United States Patent
Desaulty et al.

(10) Patent No.: US 7,805,943 B2
(45) Date of Patent: Oct. 5, 2010

(54) SHROUD FOR A TURBOMACHINE COMBUSTION CHAMBER

(75) Inventors: Michel Andre Albert Desaulty, Vert St Denis (FR); Michel Pierre Cazalens, Bourron Marlotte (FR); Olivier Kreder, Chailly En Biere (FR); Alain Cayre, Pamfou (FR)

(73) Assignee: SNECMA, Paris (FR)

( * ) Notice: Subject to any disclaimer, the term of this patent is extended or adjusted under 35 U.S.C. 154(b) by 732 days.

(21) Appl. No.: 11/275,859

(22) Filed: Feb. 1, 2006

(65) Prior Publication Data

US 2006/0174626 A1 Aug. 10, 2006

(30) Foreign Application Priority Data

Feb. 9, 2005 (FR) ..... 05 50379

(51) Int. Cl.
*F02C 7/20* (2006.01)

(52) U.S. Cl. ..... 60/752; 60/798; 60/800

(58) Field of Classification Search ..... 60/798, 60/752, 800, 779, 39.091, 39.094; 220/749, 220/745–750; 137/587
See application file for complete search history.

(56) References Cited

U.S. PATENT DOCUMENTS

| | | | | |
|---|---|---|---|---|
| 2,901,032 | A | 8/1959 | Brola | |
| 3,500,639 | A * | 3/1970 | Stamm | 60/797 |
| 5,181,379 | A * | 1/1993 | Wakeman et al. | 60/766 |
| 5,524,430 | A | 6/1996 | Mazeaud et al. | |
| 6,792,757 | B2 * | 9/2004 | Borns et al. | 60/772 |
| 7,062,920 | B2 * | 6/2006 | McMasters et al. | 60/800 |

FOREIGN PATENT DOCUMENTS

| | | |
|---|---|---|
| DE | 199 00 025 A1 | 7/2000 |
| EP | 0 562 792 A1 | 9/1993 |
| WO | WO 2004/113794 A1 | 12/2004 |

* cited by examiner

*Primary Examiner*—Michael Cuff
*Assistant Examiner*—Vikansha S Dwivedi
(74) *Attorney, Agent, or Firm*—Oblon, Spivak, McClelland, Maier & Neustadt, L.L.P.

(57) ABSTRACT

A shroud for a combustion chamber bottom designed to cover fuel injectors is provided with drillings on at least one of its sides to open up the cavity within the shroud and reduce noise that it produces and combustion instabilities. The drillings also have the effect of reducing instabilities and non-uniformity of the airflow around the shroud.

11 Claims, 3 Drawing Sheets

SHROUD FOR A TURBOMACHINE COMBUSTION CHAMBER

The subject of this invention is a shroud for a turbomachine combustion chamber.

Such shrouds cover the rear side of fuel injectors and protect them from shocks due to the ingestion of bodies such as blocks of ice or birds into the machine. They are approximately semi-toroidal in shape and extend between two concentric attachment edges to the edges of an annular chamber bottom plate surrounding the combustor. Injectors extend through this plate. A central portion of the shroud is open to allow fuel injection pipes to pass through to the injectors. The openings may be a single circular slit (the shroud then being composed of two concentric and separated sides called "caps"), or consist of a sequence of windows each leading to a group of injectors.

The combustion chamber inside which the shroud extends often produces excessive noise due to unstable combustion and vibrations. A reduction in acoustic emissions may be achieved by adding stiffeners or dampers to the structure that produces them, but this makes manufacturing less simple, and increases the weight or the flow quality. Other methods consist of dynamic control of combustion, but they do not yet have any practical application. Since it is difficult to obtain good results with these known methods, restriction of instabilities is sometimes neglected, although this is becoming less and less acceptable due to increasingly stringent requirements for noise reduction and correct operation to be satisfied by engines.

Shrouds must also enable satisfactory flow of combustion air. Their rounded shape enables smooth flow with little turbulence around them; but this favourable flow is only guaranteed under nominal operating conditions, and it is found that the shape of the shroud is no longer adapted under other conditions; flow separation and non-uniform pressures may occur on some portions of the sides of the shroud.

The invention was designed to overcome these deficiencies. It is based on an improvement to the shroud design without any added material. Its essential characteristic is that at least one of the sides of the shroud is provided with at least one row of drillings. The drillings hinder the formation of a resonant cavity in the volume formed in the shroud and therefore reduce noise output from it. According to other information disclosed in the invention, they also contribute to regulating the airflow for all machine operating modes, by eliminating pressure differences between the inside and the outside of the shroud.

One purpose of the invention is a shroud for a turbomachine combustion chamber covering a circular row of fuel injectors provided with an open central portion and two sides joining the central portion at two concentric edges at which the shroud is attached to an annular bottom plate of the combustion chamber, characterised in that at least one of the sides is provided with at least one row of drillings.

Another aspect of the invention is a turbomachine combustion chamber including a case delimiting a diffusion chamber, a flame tube placed in the case, a compressor diffuser opening up into the diffusion chamber and forming a starting point for a first gas flow into the diffusion chamber, the flame tube comprising a shell and a shroud attached to the shell and facing the compressor diffuser, the shroud covering a circular row of fuel injectors and being provided with an open central portion and two concentric sides joining the central portion to the shell, the first flow being in the direction from the diffuser towards the open central portion, then going round the shroud passing along the sides and finally along the shell, characterised in that at least one of the sides is provided with at least one row of drillings.

Another aspect of the invention is a turbomachine equipped with this shroud or this combustion chamber.

The invention will now be described with reference to the following figures.

Figure 1:
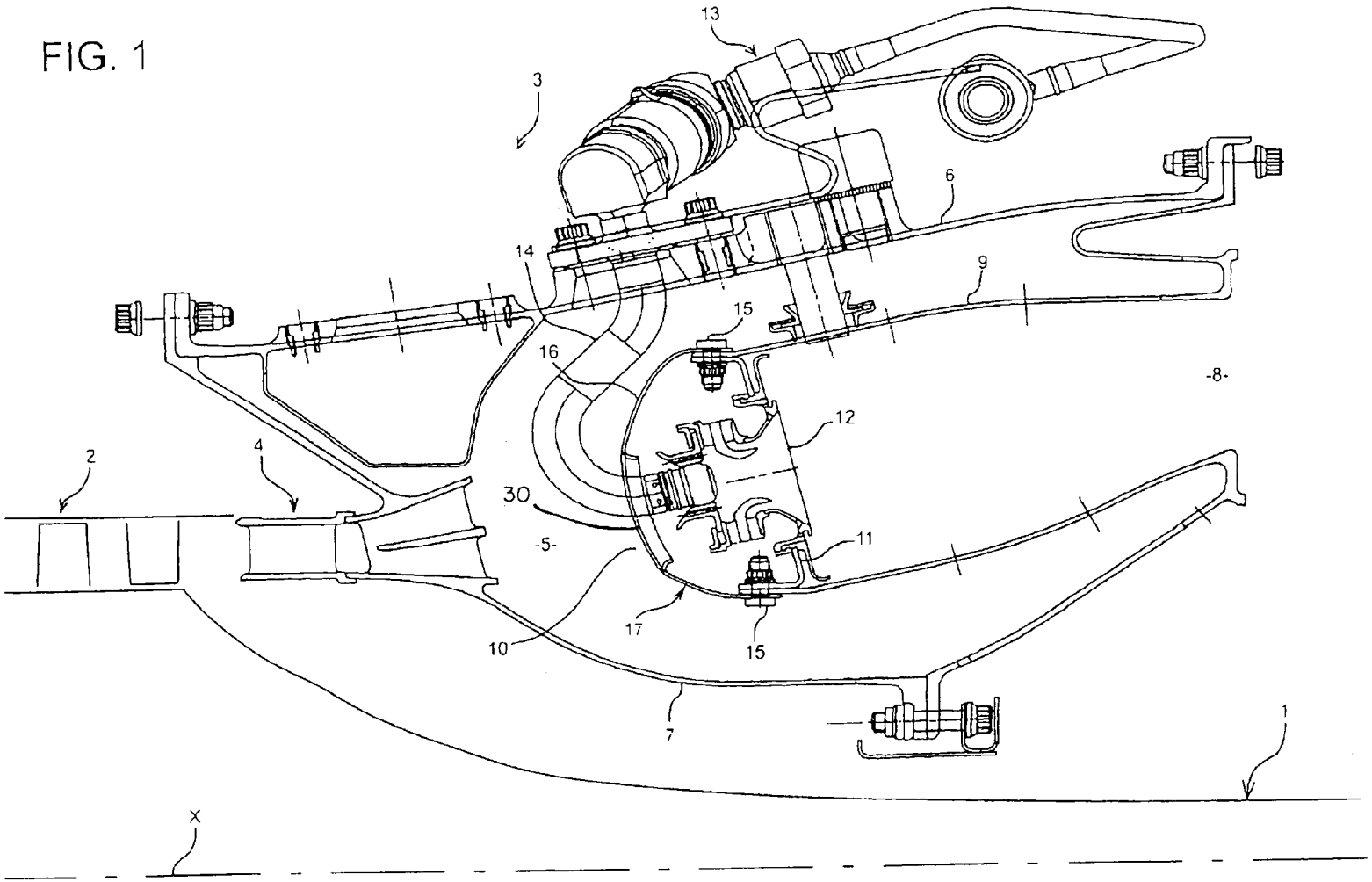
FIG. 1 is an overview of a combustion chamber including a shroud.

FIG. 1 shows a sectional view along an axial plane through the machine, taken from only one side of the axis of rotation X of the rotor 1 of the machine. This turbomachine is shown only partially, in the equipped part of the invention, the remainder not being changed from prior art. On the downstream side of a high pressure compressor 2, a stator 3 of the machine comprises a diffuser 4 opening up into a diffusion chamber 5 delimited by an external case 6, an internal case 7 concentric with it and occupied by a flame tube 8 supported by cases 6 and 7 and composed of a shell 9 composed of two concentric approximately cylindrical casings at the front, a rounded shroud 10 at the back and a chamber bottom plate 11 separating the flame tube 8 from the volume in the shroud 10. The chamber bottom plate 11 supports fuel injectors 12 connected with a fuel supply system 13 that supplies them through the pipes 14 passing through the diffusion chamber 5 and the shroud 10. It can be seen that the edges of the chamber bottom plate 11, the shell 9 and the shroud 10 are assembled with bolts 15 by superposing them in this order from the inside to the outside. The bolts 15 form two concentric circles and are associated with two edges of each of these parts.

The shroud 10 comprises two circular and concentric edges 16 and 17 on each side of the opening 30 through which the supply pipes 14 pass. In traditional embodiments of the shroud 10, the sides 16 and 17 are completely separated by an annular opening and assembled to the rest of the stator separately.

The invention could equally well be applied to a single piece shroud in which the central circular slit is replaced by a sequence of shorter slits separated by radial bridges joining the sides 16 and 17 to each other.

Figure 2:
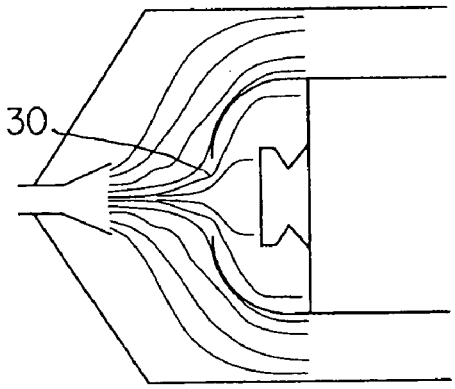
FIGS. 2 and 3 illustrate two flow modes.
Figure 3:
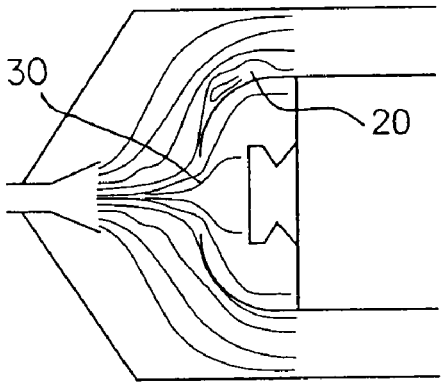

The airflow at the output from the diffuser 4 preferably passes along a path represented by the arrows and the current lines in FIG. 2, which essentially goes round the shroud 10 forming a flow that should be smooth along its sides 16 and 17, in other words tangent to them over their entire length. The airflow output from the diffuser 4 is directed firstly towards the centre of the shroud 10. It branches off in front of the shroud 10 towards the downstream side of the turbomachine, and then passes in front of the outside casing and the inside casing of the shell 9, which is thus cooled. This main flow or first flow is completed by a second flow, also output from the diffuser 4, which enters into the shroud 10 and then the flame tube 8 through central openings in the shroud 10. However, some operating modes of the machine may impose a flow like that shown in FIG. 3, in which a separation 20 associated with an approximately stagnant air pocket occurs in front of a portion of the outside face of the outer side 16 of the shroud 10. More generally, separation of the first flow often occurs just on the downstream side of a portion with a larger curvature on the sides 16 and 17 and particularly on the outer side 16 close to the connection to the shell 9.

Figure 4:
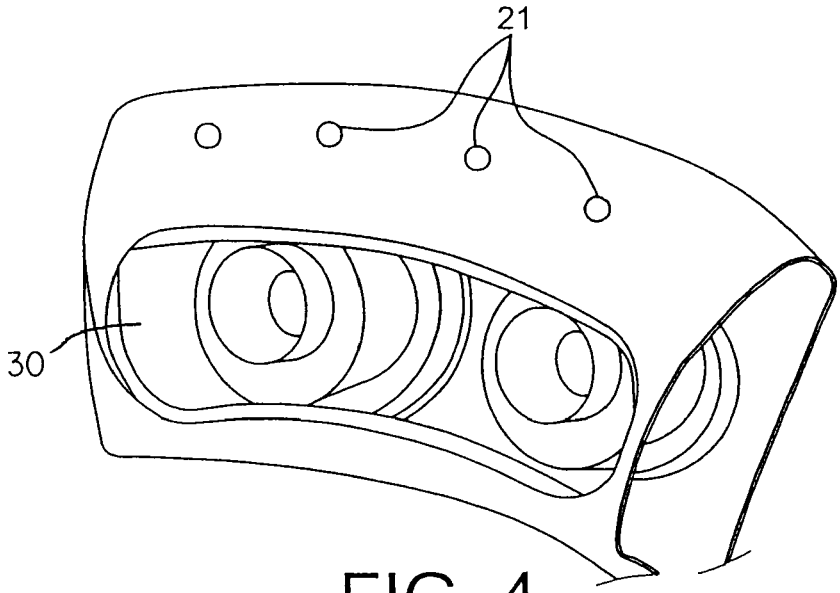
FIG. 4 illustrates an embodiment of the invention.

According to the invention, the shroud 10 can be drilled as shown in FIG. 4. The drillings 21 may be circular or oblong, oval or rectangular, but circular drillings are easier to produce. They are produced in circular rows on the sides 16 and 17 of the shroud 10, or on only one of the sides 16 and 17, with a uniform or non-uniform distribution on the rows. A series of closely spaced circular drillings gives a result similar to the result for an oblong drilling.

These drillings favourably coincide with the locations at which separation 20 might occur. Their main effect is to reduce noise emission produced in the internal volume of the shroud 10. This emission originates from combustion and it is applied by acoustic coupling between the shell 9 and the shroud 10, that is attenuated by drillings 21 located not far from the location of the connection to the shell 9 or the chamber bottom plate 11, by efficiently opening up the acoustic cavity in the shroud 10. Note that the central openings for the passage of fuel injectors do not have an important effect on noise reduction despite their large area, which suggests that the smaller but better placed drillings 21 formed on the sides 16 and 17 have a surprising effect.

Figure 7:
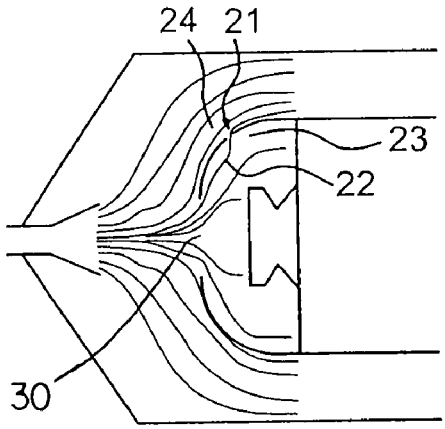
FIG. 7 shows an effect of the invention.

Efficient locations for the drillings 21 frequently coincide with the separation locations 20, such that well placed drillings 21 also help to restore a uniform flow. The technical effect will be as shown in FIG. 7; a portion 22 of the second flow mentioned above, that entered the shroud 10 and passes along the inside face of the sides 16 and 17 passes through drillings 21 well placed in front of the separation locations 20 at which the pressure is negative. This portion 22 of the second flow passes from the high pressure side 23 towards the low pressure side 24, which tends to equalize them by creating current lines that are more closely parallel, and making the flow shape more uniform. Therefore, drillings 21 can often be made slightly on the downstream side of the portions of the sides 16 and 17 with higher curvature, particularly on the outside side 16, or at the end of such strongly rounded parts where there is a large change in the flow direction of the air.

Figure 5:
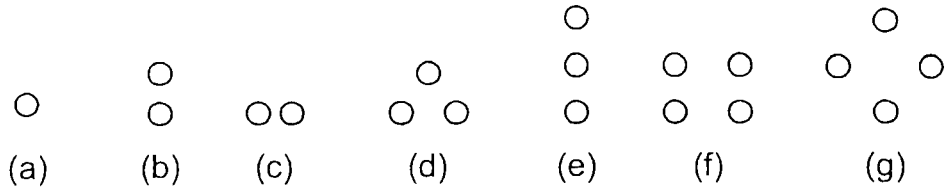
FIGS. 5 and 6 illustrate some patterns used in the invention.
Figure 6:
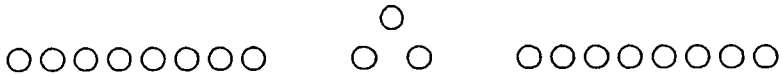

FIG. 4 shows one possible configuration of the invention with a single row of drillings 21. More complex patterns associated with groups of drillings can give better results. FIG. 5 shows a few such patterns, adjacent to the elementary pattern (a) composed of a single drilling 21 in FIG. 4, patterns of two or three drillings in the axial direction (b or e), or the tangential direction (c), in a triangular arrangement (d), a square arrangement (f) or a diamond-shaped arrangement (g). Rows of drillings may include more or less uniform combinations of this type of patterns. FIG. 6 shows an example in which patterns composed for example of eight close-up drillings aligned in a tangential direction alternate with triangles. Optimisation depends on specific flow conditions and the degree of improvement required; in particular, it will be determined empirically so that there is no need to define any rules apart from these examples.

Although it will often be useful to create several rows of drillings 21 in order to increase the flow uniformity, a single well-placed row of drillings 21 is often sufficient to give a better noise reduction.

Obviously, drillings according to the invention need to be distinguished from drillings of the edges of the shroud 10 that are used to hold bolts 15 for fixing to the chamber bottom plate 11, so that they are closed off and do not have the same properties as the drillings according to the invention; the same is true for the large number of small diameter drillings made through the shell 9 of the flame tube 8, the role of which is to create an airflow towards the flame tube 8 under all circumstances to keep it at a moderate temperature while participating in combustion as long as the combustor is reached.

The invention claimed is:

1. A shroud for a turbomachine combustion chamber covering a circular row of fuel injectors and an annular chamber bottom plate of the combustion chamber which supports the fuel injectors, the shroud comprising:

a central portion comprising at least one opening through which supply pipes of the injectors pass;

first and second concentric attachment portions that attach the shroud to the chamber bottom plate in the combustion chamber;

a first side disposed between the central portion and the first attachment portion; and a second side disposed between the central portion and the second attachment portion, the second side being opposite the first side, wherein at least one of the first or second sides comprises at least one row of drillings distinct from said openings that remain open when the shroud is mounted in the combustion chamber so as to provide gas communication through said shroud via said drillings.

2. A shroud according to claim 1, wherein the row of drillings is composed of circular drillings uniformly arranged on a circumference of the shroud.

3. A turbomachine combustion chamber comprising:

a case that delimits a diffusion chamber;

a flame tube placed in the case;

a compressor diffuser that opens up into the diffusion chamber and forms a starting point for a first gas flow into the diffusion chamber, the flame tube comprising a shell and a shroud attached to the shell, the shroud facing the compressor diffuser, the shroud covering a circular row of fuel injectors and an annular chamber bottom plate of the combustion chamber, the shroud comprising a central portion comprising at least one opening through which supply pipes of the injectors pass, first and second attachment portions that attach the shroud to the shell, a first side disposed between the central portion and the first attachment portion, and a second side disposed between the central portion and the second attachment portion, the second side being opposite the first side, the first gas flow being in the direction from the diffuser towards the central portion, then going round the shroud passing along the sides and finally along the shell, wherein at least one of the first or second sides is provided with at least one row of drillings distinct from said openings that remain open when the shroud is attached to said shell so as to provide gas communication through said shroud via said drillings.

4. A turbomachine combustion chamber according to claim 3, wherein the drillings are made at locations of separation of the first flow.

5. A turbomachine combustion chamber according to either claim 3 or 4, wherein the diffuser forms a starting point of a second gas flow in the diffusion chamber, the second gas flow being oriented from the diffuser towards the central portion, then passing through the central portion on the shroud side facing the flame tube, and passing along the first and second sides and joining the first gas flow by passing through the row of drillings.

6. A turbomachine comprising a shroud according to claim 1.

7. A turbomachine comprising a combustion chamber according to claim 3.

8. A turbomachine comprising a shroud according to claim 2.

9. A turbomachine combustion chamber according to claim 3, wherein said drillings are on both the first and second sides.

10. A turbomachine combustion chamber according to claim 3, wherein said shroud further defines bolt drillings positioned at the first and second attachment portions and further comprising bolts in said bolt drillings such that said bolt drillings are closed off, said bolts being configured to fix said shroud to said shell.

11. A turbomachine combustion chamber according to claim 10, wherein said drillings in said at least one of the first or second sides are remote from said edges and are free of any bolt when said shroud is fixed to said shell.

* * * * *